US009274450B2

(12) United States Patent
Fukuda et al.

(10) Patent No.: US 9,274,450 B2
(45) Date of Patent: Mar. 1, 2016

(54) CHARGING DEVICE

(71) Applicant: CANON KABUSHIKI KAISHA, Tokyo (JP)

(72) Inventors: Tadashi Fukuda, Matsudo (JP); Yoshiro Nishino, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/524,607

(22) Filed: Oct. 27, 2014

(65) Prior Publication Data

US 2015/0063860 A1 Mar. 5, 2015

Related U.S. Application Data

(63) Continuation of application No. PCT/JP2013/062867, filed on Apr. 26, 2013.

(30) Foreign Application Priority Data

Apr. 27, 2012 (JP) ..... 2012-102470

(51) Int. Cl.
*G03G 15/02* (2006.01)

(52) U.S. Cl.
CPC ..... *G03G 15/0291* (2013.01); *G03G 15/02* (2013.01)

(58) Field of Classification Search
None
See application file for complete search history.

(56) References Cited

U.S. PATENT DOCUMENTS

| | | | | |
|---|---|---|---|---|
| 8,626,020 | B2 | 1/2014 | Ikeda | |
| 8,630,567 | B2 | 1/2014 | Makino | |
| 2010/0067939 | A1* | 3/2010 | Inoue | 399/100 |
| 2010/0158550 | A1* | 6/2010 | Makino et al. | 399/45 |
| 2014/0133887 | A1 | 5/2014 | Nishino | |

FOREIGN PATENT DOCUMENTS

| | | | |
|---|---|---|---|
| JP | 2006-91484 | A | 4/2006 |
| JP | 2010-113144 | | 5/2010 |
| JP | 2011-186226 | A | 9/2011 |
| JP | 2012-63592 | A | 3/2012 |
| JP | 2012-078668 | | 4/2012 |

OTHER PUBLICATIONS

International Search Report dated Jun. 18, 2013, in Application No. PCT/JP2013/062867.

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A charging device includes: a discharging electrode; a casing surrounding the discharging electrode and being provided with an opening in a member-to-be-charged side; a grid electrode provided in the opening and provided with a mesh portion having a plurality of through holes; a cleaning brush, including a base material and a plurality of fibers held on the base material, for cleaning the grid electrode by entrance of a part of the fibers into the through holes while contacting a surface of the grid electrode in the discharging electrode side; a shutter capable of shielding between the member-to-be-charged and the grid electrode; and a moving mechanism for moving the cleaning brush and the shutter along a longitudinal direction of the grid electrode. When the shutter is moved in a closing direction, the cleaning brush moves in advance of a leading end portion of the shutter with respect to the closing direction by a predetermined interval or more.

5 Claims, 10 Drawing Sheets

(a)

(b)

(a)

BRUSH FIBER LENGTH : l
GRID-BRUSH BASE : h
GRID -CONTACT ANGLE : $\theta$ (b)

DELAY AMOUNT OF
BRUSH LEADING END : $L=\sqrt{(l^2-h^2)} \times \sin\theta$ (a)

(b)

CHARGING DEVICE

TECHNICAL FIELD

The present invention relates to a charging device.

BACKGROUND ART

An image forming apparatus of an electrophotographic type in which a photosensitive member is electrically charged by a corona charger. Especially, a product using the corona charger which is called scorotron including a grid electrode for stabilizing a charge potential of the photosensitive member has been known. Here, the grid can be divided into two types depending on a shape of the grid. One is a wire grid in which a wire is stretched in a longitudinal direction of an opening, and the other is an etching grid in which a mesh having many holes in a flat plate is formed by etching. In most of the etching grids, for the purpose of improving charging uniformity, thin lines constituting the mesh are oblique to a discharging wire.

The etching grid has an advantage, compared with the wire grid, such that the opening is covered in a wide area (low opening (aperture) ratio), and therefore the photosensitive member is easily controlled to a target potential (high potential convergence property). On the other hand, in the etching grid, compared with the wire grid, a foreign matter (a toner, an external additive, an electric discharge product or the like) is liable to be deposited on the grid.

On the other hand, in the corona charger, when the electric discharge product (ozone, nitrogen oxide or the like) generated with electric discharge is deposited on the photosensitive member, the electric discharge product takes up moisture in a high-humidity environment and causes image defect which is called image flow. Therefore, a constitution in which with respect to a cleaning member for cleaning a surface of the grid electrode and an opening of the corona charger, the grid electrode is cleaned and the same time the opening is shielded by moving a sheet-like shutter in a longitudinal develop of the opening is described in Japanese Laid-Open Patent Application 2012-063592.

In a constitution in which a brush for cleaning the grid and the shutter are provided, when a commonality between the shutter and a driving source is achieved, the number of driving sources (motors) can be suppressed and therefore the commonality is preferred. On the other hand, after the grid is cleaned by the cleaning brush, the opening cannot be closed by the shutter. For this reason, unless a positional relationship between the shutter and the cleaning brush is taken into consideration, the foreign matter deposits on the shutter.

Especially, in a constitution in which the cleaning brush is caused to enter the etching grid to clean the etching grid, depending on shapes of the cleaning brush and the etching grid, the foreign matter deposits on the shutter. When the foreign matter deposits on the shutter, there is a liability that an agglomeration of the deposited foreign matter drops on the photosensitive member by vibration or the like during movement of the shutter, and therefore the deposition of the foreign matter is not preferred.

SUMMARY OF THE INVENTION

An object of the present invention is to suppress deposit of a foreign matter on a shutter in a charging device in which the shutter for shielding an opening provided in a casing surrounding a discharging electrode and a grid electrode provided in the opening are provided.

According to an aspect of the present invention, there is provided a charging device comprising: a discharging electrode; a casing surrounding the discharging electrode and being provided with an opening in a member-to-be-charged side; a grid electrode provided in the opening and provided with a mesh portion having a plurality of through holes; a cleaning brush, including a base material and a plurality of fibers held on the base material, for cleaning the grid electrode by entrance of a part of the fibers into the through holes while contacting a surface of the grid electrode in the discharging electrode side; a shutter capable of shielding between the member-to-be-charged and the grid electrode; and a moving mechanism for moving the cleaning brush and the shutter along a longitudinal direction of the grid electrode, wherein when the shutter is moved in a closing direction, the cleaning brush moves in advance of a leading end portion of the shutter with respect to the closing direction by a predetermined interval or more.

EMBODIMENTS FOR CARRYING OUT THE INVENTION

In the following, a schematic structure of an image forming apparatus will be described, and thereafter, a charging device will be specifically described using the drawings. Incidentally, with respect to dimensions, materials and shapes of constituent elements and relative positions thereof, an applicable range of this technical concept is not intended to be limited only thereto unless otherwise particularly specified.

[Embodiment 1]

First, the schematic structure of the image forming apparatus will be briefly described, and thereafter, the charging device (corona charger) will be specifically described.

1. About Outline of Image Forming Apparatus

In the following, a portion (image forming portion) relating to image formation of a printer 100 will be briefly described.

(About Schematic Structure of Entire Apparatus)

Figure 1:
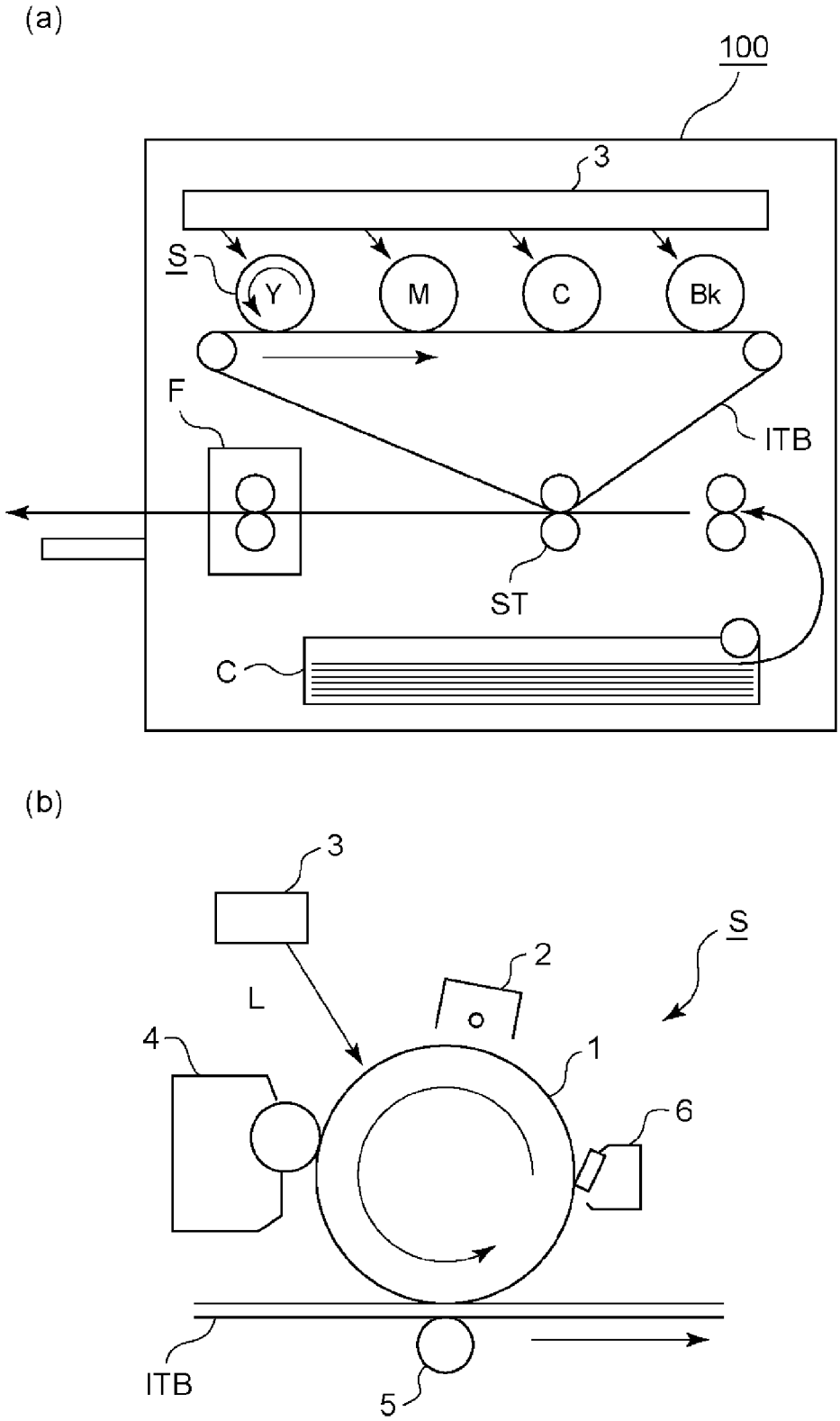
FIG. 1 includes schematic sectional views of an image forming apparatus.

In FIG. 1, (a) is a schematic view for illustrating a schematic structure of the printer 100 as the image forming apparatus. The printer 100 as the image forming apparatus includes first to fourth stations S (Bk to Y) in which images are formed on respective photosensitive drums with different toners. In FIG. 1, (b) is an enlarged detailed view of the station as an image forming portion. The respective stations are the substantially same except for species (spectral characteristics) of the toners for developing electrostatic images formed on the photosensitive drums, and therefore the first station (Y) will be described as a representative.

The station S (Y) positioned as the image forming portion in an upstreammost side includes a photosensitive drum 1 as a member-to-be-charged and a corona charger 2 as the charging device for electrically charging the photosensitive drum 1. The photosensitive drum 1 is charged by the corona charger 2, and thereafter, the electrostatic image is formed on the photosensitive drum by exposure to light L from a laser scanner 3. The electrostatic image formed on the photosensitive drum 1 (first bearing member) is developed into a toner image with a yellow toner accommodated in a developing device 4. The toner image formed (by development of the electrostatic image) on the photosensitive drum is transferred onto an intermediary transfer belt ITB as an intermediary transfer member by a transfer roller 5 as a transfer member. A transfer residual toner deposited on the photosensitive drum 1 without being transferred onto the intermediary transfer belt is removed for cleaning by a cleaning device 6 including a blade. Incidentally, the corona charger, the developing device and the like which relate to formation of the toner image on the photosensitive drum 1 (photosensitive member) is called an image forming portion. Incidentally, the corona charger 2 (charging device) will be specifically described later.

In this way, the toner images transferred from the photosensitive drums 1 provided in the respective stations in the order of yellow (Y), magenta (M), cyan (C) and black (Bk) are superposed on the intermediary transfer belt. Then, the superposed toner images are transferred at a secondary transfer portion ST onto a recording material fed from a cassette C. A toner remaining on the intermediary transfer belt without being transferred onto the recording material at the secondary transfer portion ST is removed by an unshown belt cleaner.

The toner images transferred on the recording material contact and heat-melt the toner, and are fixed on the recording material by a fixing device F for heat-fixing the toner images on the recording material and then the recording material on which the first is fixed is discharged to an outside of the machine (image forming apparatus). The above is the schematic structure of the entire apparatus.

2. About Schematic Structure of Corona Charger

In the following, a schematic structure of the corona charger will be described.

(Schematic Structure of Corona Charger)

Figure 2:
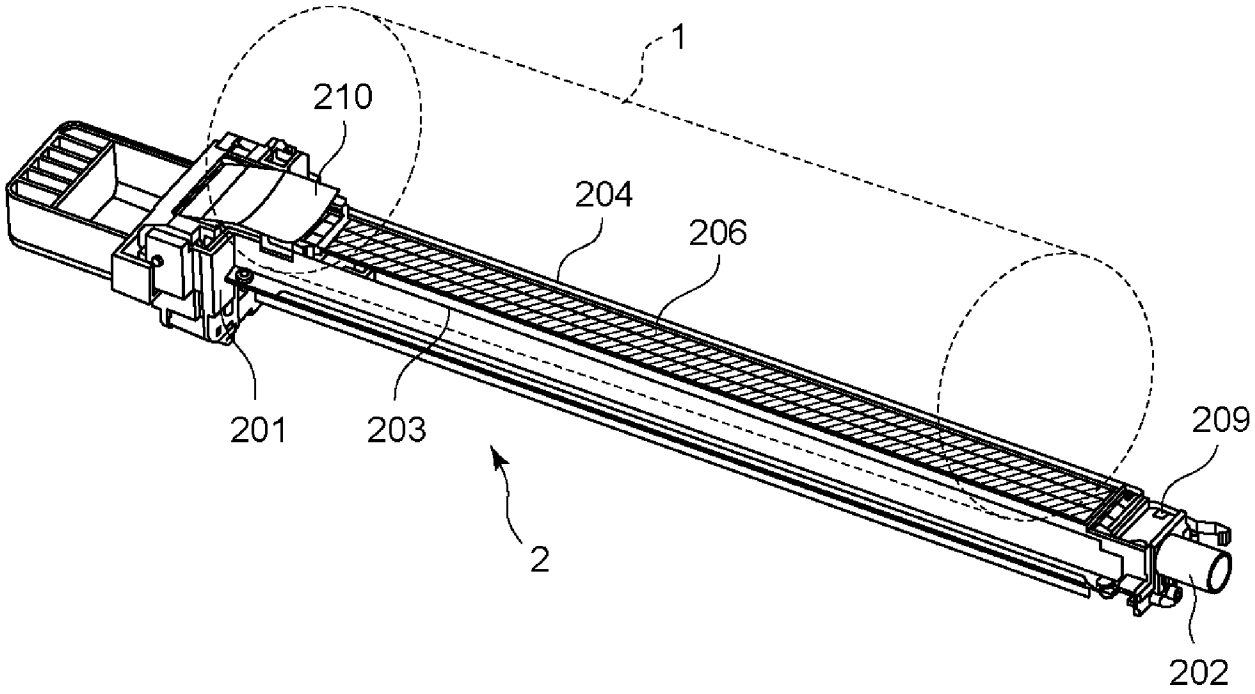
FIG. 2 is a perspective view showing an outer appearance of a corona charger according to an embodiment.
Figure 3:
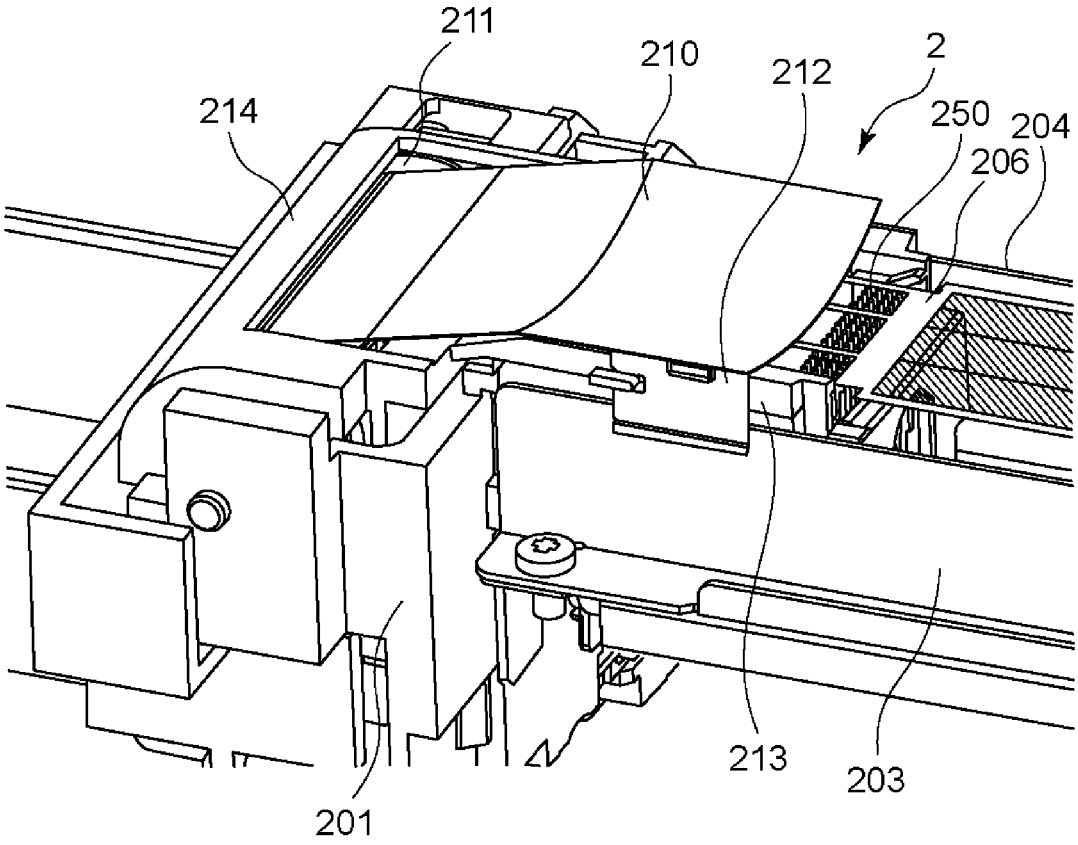
FIG. 3 is an enlarged view of the corona charger according to the embodiment in the neighborhood of a shutter accommodating portion.

FIG. 2 is a schematic perspective view of the corona charger 2 (as seen) from a photosensitive member side, and FIG. 3 is an enlarged view of the corona charger in this embodiment in the neighborhood of a shutter accommodating portion. The corona charger 2 includes a grid 206 which is a grid electrode and a cleaning brush 250 for cleaning the grid, and also includes a sheet-like shutter 210 (charging shutter) capable of shielding an opening of the corona charger in the photosensitive member side (member-to-be-charged side).

The corona charger 2 includes a front block 201, a rear block 202, and shields 203 and 204, and these members constitute a casing of the corona charger. Further, a discharging wire (charging wire) 205 is stretched between the front block 201 and the rear block 202 (see FIG. 5). The discharging wire electrically charges the photosensitive member 1 as a member-to-be-charged by generating electric discharge when a charging bias is applied from an unshown high-voltage (power) source S in FIG. 2. Incidentally, the discharging wire stretched inside a shield may have a circular cross-sectional shape or a shape like a sawtooth.

As a discharging electrode, stainless steel, nickel, molybdenum, tungsten or the like may preferably be used. In this embodiment, tungsten having very high stability among metals was stretched as the discharging wire 205 in the shield. Further, a diameter of the discharging wire may preferably be 40 μm to 100 μm. When the diameter of the discharging wire is excessively small, the discharging wire is but by ion collision due to the electric discharge. On the other hand, when the diameter of the discharging wire is excessively large, in order to obtain stable corona discharge, a voltage applied to the discharging wire 205 becomes high. When the applied voltage is high, ozone is liable to grid electrode, and in addition, a problem such that a power source cost increases arises.

In this embodiment, the discharging wire 205 is the tungsten wire of 60 μm in diameter, and was disposed in parallel to a rotational axis of the drum. As the material, tungsten which does not readily corrode is used, whereby it is possible to suppress a liability that the wire itself is broken down into dusts by corrosion and to suppress deposition of a foreign matter by an increase in surface roughness of the wire surface by the corrosion.

(About Grid Electrode)

Further, the corona charger 2 includes a flat plate-shaped grid 206 as a contact electrode in an opening, of openings formed by the shields 203 and 204, in a side opposing the photosensitive member. This grid 206 is disposed between the discharging wire 205 and the photosensitive member 1, and controls an amount of a current flowing toward the photosensitive member by being supplied with the charging bias.

Here, in this embodiment, as the grid 206 as the control electrode, a so-called an etching grid in which a thin flat metal plate (thin plate) is subjected to etching is used. The etching grid has, as shown in FIG. 3, beam portions at both end portions of the grid with respect to a longitudinal direction and has a shape such that a mesh portion having oblique small windows (through holes) between the beam portions. Incidentally, the thin plate refers to a plate-shape member of 1 mm or less in thickness.

Incidentally, as a base material of the flat-like grid 206, a material having the mesh portion formed on an about 0.03 mm-thick thin plate-like metal plate, of austenitic stainless steel (SUS 304) by etching to provide many through holes was used. Further, on the SUS constituting the base material, a protective layer was formed using a material high in chemical inertness toward an electric discharge product generated by the corona discharge. Specifically, a surface layer of tetrahedral amorphous carbon (hereinafter referred to as ta-C) was formed on the surface of the SUS which is the base material. Hereinafter, the surface layer (protective layer) consisting of ta-C is referred to as a ta-C layer. The ta-C layer formed on the surface of the base material for the grid is formed not only on flat plate surfaces as front and back surfaces of the mesh portion but also at cross-sectional edges of the through holes.

Incidentally, in this embodiment, the base material is not limited to the base materials shown above, but another austenitic stainless steel, martensite stainless steel or ferrite-based stainless steel or the like may also be used. The ta-C used for the surface layer in this embodiment is one species of DLC (diamond like carbon) in general. The DLC has an amorphous structure in which diamond bond (sp3 bond) containing hydrogen in some amount in general and graphite bond (sp2 bond) are co-present at a proportion of 7:3.

(About Mesh Shape of Grid)

Subsequently, a mesh shape of the grid will be specifically described. As shown in (a) of FIG. 7, the mesh shape is such a shape that the beam portions exist at the both end portions with respect to the grid longitudinal direction and that the through holes are obliquely arranged between the beam portions. In the following, Table 1 is a table in which respective dimensions of the grid are listed.

TABLE 1

| | |
|---|---|
| (1): | 0.312 ± 0.03 (mm) |
| (2): | 0.071 ± 0.03 (mm) |
| (3): | 45 ± 1 (°) |
| (4): | 0.1 ± 0.03 (mm) |
| (5): | 6.9 ± 0.1 (mm) |
| (6): | 1.5 ± 0.1 (mm) |

Figure 7:
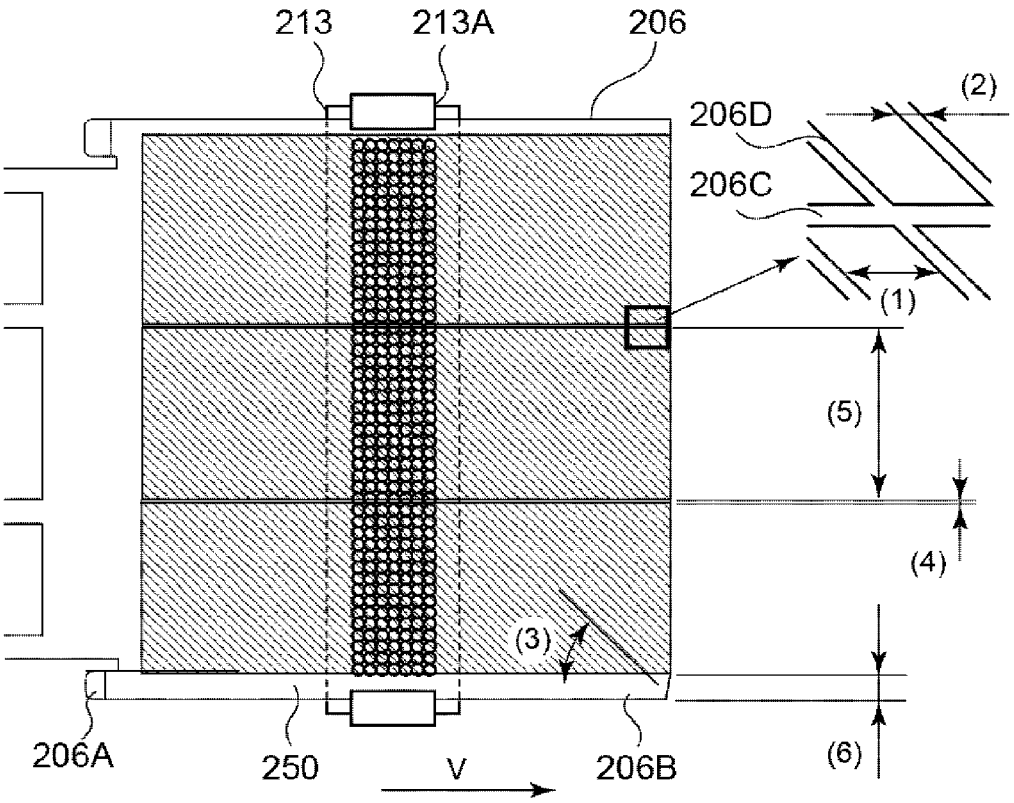
FIG. 7 includes schematic views for illustrating motion of a free end of the cleaning brush.
Figure 7:
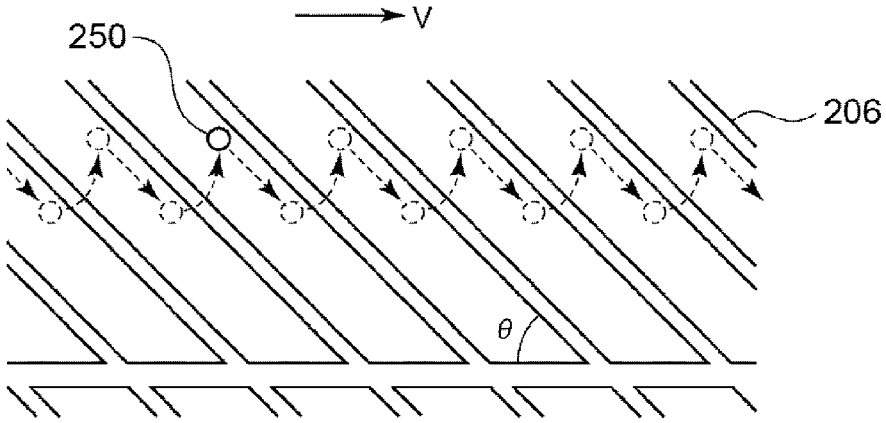

In FIG. 7, (a) is a birds-eye view of a part of the grid from the member-to-be-charged (photosensitive member) side in an enlarged manner, and the shape of the mesh portion of the grid 206 will be described below.

The grid has the mesh shape at a central portion with respect to a short direction, and with respect to a base line 206C, the through holes are formed at an angle (45±1°) set in (3), a width of 0.071±0.03 mm shown in (2) and an interval which is an opening width of 0.312±0.03 mm shown in (1).

Further, between mesh thin lines 206D, a beam 206B of 0.1±0.03 mm shown in (4) is provided with respect to a longitudinal direction every 6.9±0.1 mm shown in (5) in order to suppress flexure of the grid 206. The shape pattern containing the through holes of 1.0 mm or less in width as described above is subjected to etching, so that the charge potential can be further uniformized. With a higher areal ratio of the mesh portion to the through hole portion, the charge potential is made uniform move easily. The thin plate-like grid is disposed between the discharging wire 205 and the photosensitive drum 1. The distance between the photosensitive drum 1 and the grid 206 provides a higher effect of uniformizing the charge potential of the photosensitive drum 1 when the distance is closer (shorter). In this embodiment, the closest state between the photosensitive drum 1 and the grid was 1.5±0.5 mm. In this embodiment, when charging uniformity of the photosensitive member is studied using various etching grids for which a mesh angle (3) which is an angle formed by the longitudinal direction of the through holes relative to the longitudinal direction of the grid is changed, the mesh angle θ may only be required to be 80° or less, and was preferably in a range of 20° or more and 70° or less.

Incidentally, the mesh shape of the grid is not intended to be limited to the above constitution. For example, a flat plate-like grid having a honeycomb structure shape as seen in, e.g., Japanese Laid-Open Patent Application 2005-338797 may also be employed.

(About Cleaning Pad and Cleaning Brush)

In this embodiment, a cleaning pad 216 as a wire cleaning member was provided s as to sandwich the discharging wire 205 from both sides by using a sponge, made of a fine-retardant CR rubber, having a hardness of 30±5°. Incidentally, as the cleaning pad, not only the sponge, but a sheet on which abrasive particles such as alumina (particles) are applied at a contacting surface contacting the discharging wire 205 may also be contacted to the discharging wire 205. As a material for the cleaning brush, nylon, PVC (polyvinyl chloride), PPS (polyphenylene sulfide resin) or the like may also be used. Further, the material is not limited to a material of a fiber-planted type, but may also use a pad (elastic member) such as a felt or a sponge, or a sheet on which an abrasive such as alumina or silicon carbide is applied.

Further, as a material for a carriage (brush holder) 213, for holding the cleaning brush as the grid cleaning member for cleaning the grid, ABS resin was used. Incidentally, as the material for the carriage 213, a resin such as PC may also be used. The cleaning brush was provided so as to enter the mesh of the grid from a discharging wire side (discharge electrode side).

The cleaning brush 250 as the grid cleaning member used an acrylic brush, as fibers, which was subjected to a fine-retardant treatment and then was woven in a base cloth (base material). In this embodiment, as the cleaning brush 250, an acrylic pile of 9 decitex in thickness was woven at a density of 70,000 fibers/inch was used, and an entering amount of the cleaning brush 250 into the etching grid during grid cleaning was a length of 0.7-1.0 mm.

(About Grid Pulling-in Mechanism and Cleaning Property)

The corona charger in this embodiment includes a mechanism for pulling in the grid toward the wire side when the grid is cleaned by the cleaning brush. During the cleaning by pressing the cleaning brush against the grid from the discharging wire side, when the grid is pressed toward the photosensitive member side by the cleaning brush, there is a possibility that the grid is deformed and contacts the photosensitive member. Therefore, the corona charger presses the grid from the member-to-be-charged side to pull in (move) the grid toward the discharging wire side, whereby the grid is stably cleaned without being contacted to the photosensitive member.

Figure 5:
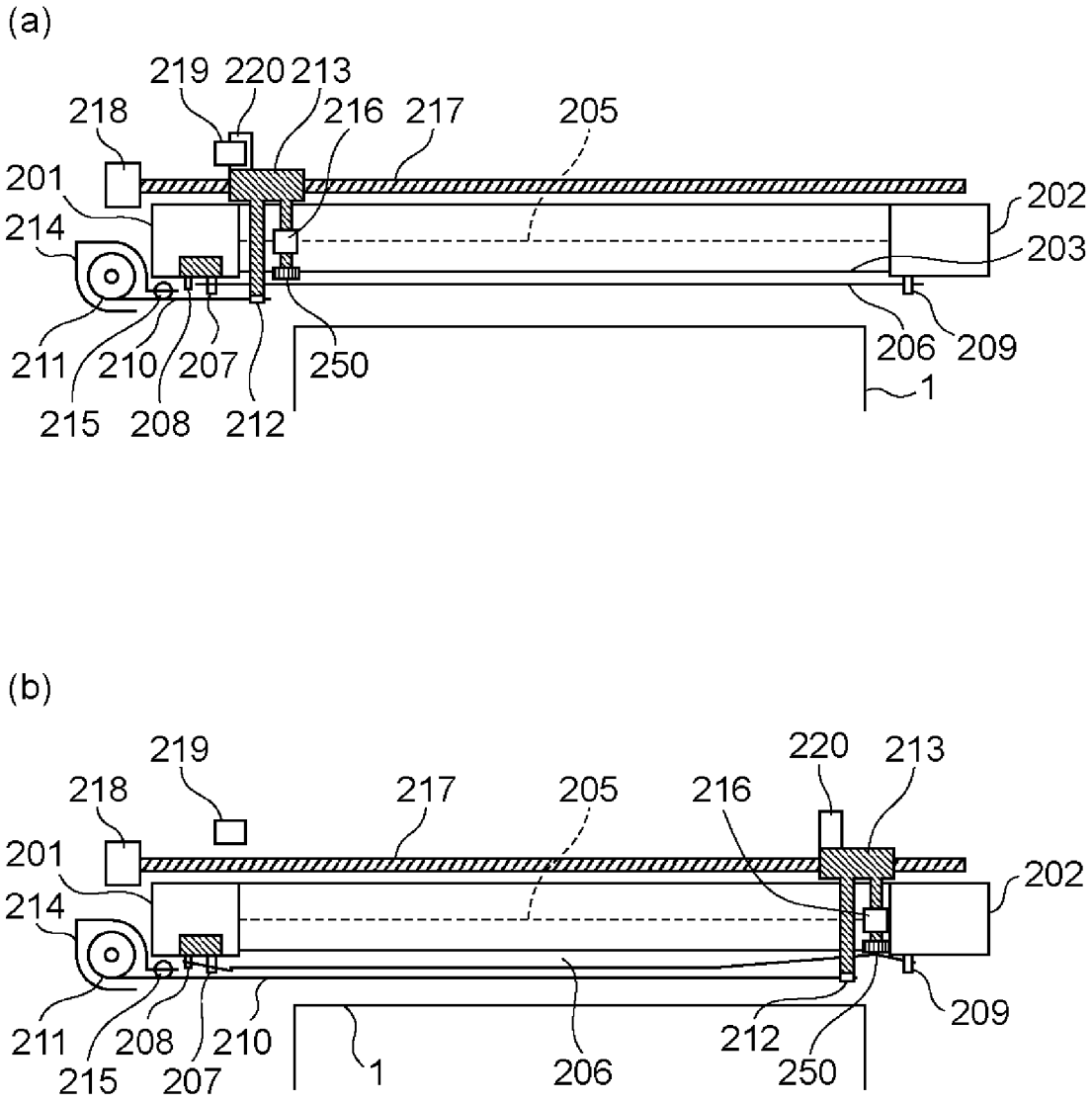
FIG. 5 includes side views of the corona charger according to the embodiment during a shutter opening/closing operation.

As shown in (a) of FIG. 5, as a pulling-in (constitution) of the grid for charging the photosensitive member in a state in which the opening is open (the shutter opens), a constitution carried out during reciprocal movement for cleaning the grid was employed.

Figure 6:
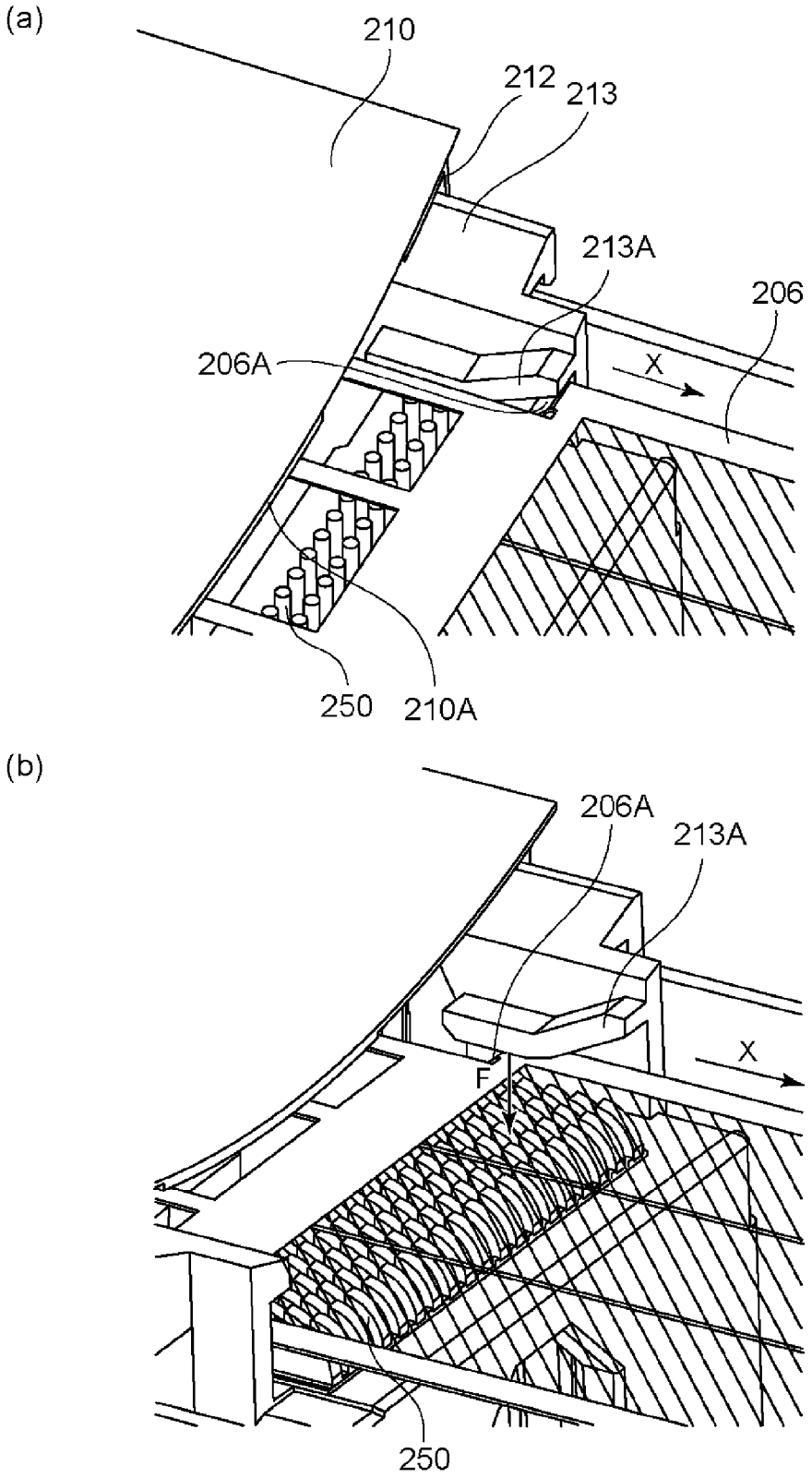
FIG. 6 includes enlarged views relating to a pulling-in operation in the neighborhood of a cleaning brush according to the embodiment.

FIG. 6 includes enlarged views for specifically illustrating the above constitution. As shown in (a) of FIG. 6, in order to retract the grid toward the discharging wire side, the carriage 213 was provided with a tapered portion 213A for moving the grid toward the wire side. This tapered portion 213A maintains a relative distance of 2.0 mm between a leading end position 212A of the shutter and the grid longitudinal direction. Further, the grid 206 has a partly cut-away shape so as not to contact the tapered portion of the carriage located at a shutter open position.

At the shutter open position, the tapered portion 213A as a grid pulling-in portion is positioned at a cut-away portion of the grid 206. For that reason, the grid is stretched by a stretching portion at a charging position substantially parallel to the photosensitive member without contact of the tapered portion 213A with the grid 206 during a charging operation. Further, in order to facilitate engagement with the tapered portion provided on the carriage, the grid 206 has an inclined surface 206A bent toward the discharging wire side.

As shown in (b) of FIG. 6, a leading end portion 210A of the shutter 210 is urged by a leaf spring in an arch shape, and is positioned at a position where the opening of the grid opens. The carriage 213 moves in an arrow X direction in the figure, so that the tapered portion 213A for pulling in the grid of the carriage 213 toward the discharging wire side and the inclined surface 206A contact each other. When the carriage moves in the arrow X direction than the position shown in (b) of FIG. 6, the grid receives a force from the tapered portion 213A of the carriage, so that a part thereof deforms toward the discharging wire side.

(About Shutter and Shutter Accommodating Portion)

Subsequently, the shutter and a constitution for winding up and accommodating the shutter will be described using FIG. 3.

The corona charger 2 includes the sheet-like shutter 210 for shielding an entire area (width: about 300 mm) of at least a portion, where the image is formed on the photosensitive member, of the opening (width: about 360 mm) where a casing having the shield opposes the photosensitive member. The shutter 210 moves in a gap between the grid 206 and the photosensitive member 1 to open and close the opening of the casing. In the image forming apparatus in this embodiment, in a shutter open state, the distance at the closest portion between the grid 206 and the photosensitive member 1 is about 1.0 mm which is narrow. For that reason, even when the photosensitive member and the shutter contact each other, in order to prevent the photosensitive member from being damaged, as the shutter 210, a nonwoven fabric, containing rayon fiber, as a sheet-like material which is soft and flexible was used.

The shutter 210 is wound up in a roll shape and accommodated at an end portion of the corona charger 2 with respect to the longitudinal direction by a winding-up mechanism 211 for winding up the shutter. This winding-up mechanism 211 includes a roller by which a shutter end portion is fixed and a torsion coil spring for urging the roller. The shutter 210 is urged by the torsion coil spring in a shutter winding-up direction (opening open direction), and as a result, a longitudinal central portion of the shutter does not readily sag. The winding-up mechanism 211 is held, by the front block 201, together with a holding case 214 for holding the winding-up mechanism 211. In the neighborhood of a shutter pulling-out portion of the holding case 214, a guiding roller 215 for guiding the shutter 210 in order that the shutter 210 does not contact an edge of the grid 206, the stretching portion 207, a knob 208 thereof, and the like is provided.

Further, the other end of the shutter 210 with respect to the longitudinal direction is fixed to the leaf spring 212. The leaf spring 212 holds the shutter and pulls the shutter in a closing direction, and also provides stiffness to the shutter by regulating the sheet-like shutter in the arch shape. Specifically, the central portion of the shutter with respect to the short direction is regulated by the leaf spring so as to have a convex shape toward the discharging wire side.

Further, the leaf spring 212, as a pulling member and also as a regulating member, for holding the neighborhood of the leading end of the shutter 210 is connected to a carriage 213 as a movable member. Incidentally, in this embodiment, the thickness of the shutter 210 is 0.15 mm, and as the leaf spring 212, a metal material of 0.10 mm in thickness was used.

The shutter 210 shields, in a state in which the shutter 210 closes the opening, at least an entire image forming area in which the electrostatic image is formed by exposure of the photosensitive member to light ((b) of FIG. 5). For that reason, if a state in which a portion where the image is substantially formed is covered with the shutter is created, even when some gap exists, an occurrence of an image flow can be sufficiently suppressed, and therefore the state is regarded as a state in which the shutter sufficiently closes the opening.

(About Shutter and Moving Mechanism for Cleaning Brush)

A moving mechanism for transmitting a driving force for moving the above-described cleaning brush and the shutter in the longitudinal direction of the corona charger will be briefly described. As shown in FIG. 5, the cleaning brush 250 and the shutter leading end are integrally held by the carriage 213. Further, the carriage 213 is moved by receiving the drive from a screw 217 provided at an upper portion of the corona charger. The carriage 213 moves toward a rear side (opening closing direction), whereby the shutter 210 is pulled out from the winding-up mechanism 211. Further, when the carriage 213 moves toward a front side (opening open direction), the shutter 210 is wound up by the winding-up mechanism 211 and is accommodated in the holding case 214.

At that time, the cleaning brush 250 as the grid cleaning member connected to the carriage 213 cleans the grid 206. In this embodiment, the shutter 210 and the cleaning brush 250 are driven by a single screw 217, and therefore the shutter 210 and the cleaning brush 250 operate in interrelation with each other.

In FIG. 5, (a) is a side view of the corona charger 2 in a state in which the carriage 213 is in a home position. The carriage 213, as the movable member in this embodiment, capable of moving in the longitudinal direction of the corona charger is driven by the screw 217 and an opening/closing motor 218 and moves in the longitudinal direction of the corona charger.

Here, the corona charger 2 includes a position sensor 219 and a detection flag 220 for shielding a detecting portion of the position sensor 219 at the shutter open position. The position sensor 219 detects that the shutter 210 is in the open position (home position) by shielding the detecting portion with the detection flag 220.

3. About Opening/Closing of Shutter and Grid Cleaning

Figure 4:
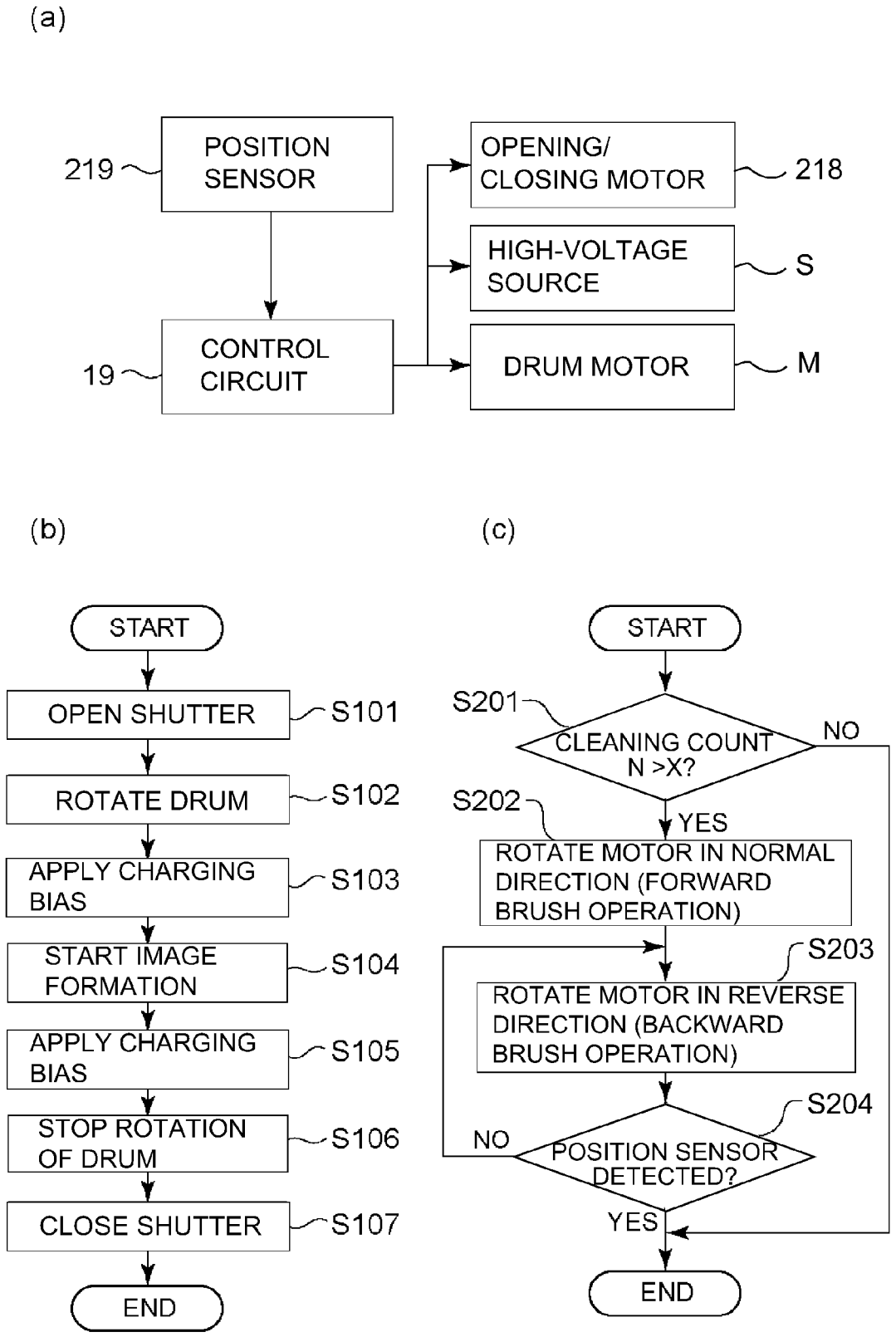
FIG. 4 includes schematic views for illustrating shutter opening/closing control of the corona charger according to the embodiment.

Then, an opening/closing operation of the shutter and a cleaning operation by the cleaning brush will be briefly described. In FIG. 4, (a) is a block diagram for illustrating a connection relationship of a control circuit with other elements, and (b) of FIG. 4 and (c) of FIG. 4 are flowcharts for illustrating the contents of control.

As shown in (a) of FIG. 4, a control circuit (controller) C as a control means controls, in accordance with a problem held therein, an opening/closing motor as a driving source, a high-voltage source, and a drum motor. Further, the position sensor notifies the control circuit of presence or absence of the flag.

(About Opening/Closing Control)

In FIG. 4, (b) is the flowchart for illustrating an operation of the corona charger during the image forming operation.

The control circuit C receives an image forming signal and then moves, on the basis of an output of the position sensor 219, the shutter so as to open the opening by driving the opening/closing motor in the case where the shutter is in the closed state, and then confirms, by the position sensor, that the shutter opened (S101). Then, in a state in which the shutter is retracted (the opening opens), the control circuit C drives the drum motor M to rotate the photosensitive member 1 (S102).

Further, in order to charge the photosensitive member, the control circuit C effects control so that the charging bias is applied from the high-voltage source S to the discharge electrode and the grid (S103). Other image forming portions are caused to act on the photosensitive member 1 charged by the corona charger 2, so that the images are formed on the sheet (S104). After an end of the image formation, the control circuit C stops the application of the charging bias to the corona charger (S105), and then stops the rotation of the photosensitive member (S106).

After the step of the photosensitive member rotation, the control circuit C reversely rotates the opening/closing motor 218 to execute an operation in which the opening is closed by the shutter (S107). Incidentally, the closing operation of the shutter 210 may be performed immediately after the image formation or may also be carried out after a lapse of a predetermined time from the end of the image formation. As described above, also the cleaning brush is moved in interrelation with the opening/closing operation of the shutter 210, and cleans the grid surface.

(About Discharging Wire and Grid Cleaning Operation)

When the image formation is repetitively effected, on the grid surface, the electric discharge product, a dust, scattered toner and external additive, and the like deposit. When a foreign matter deposits on the grid, the charge potential at that portion is shifted, so that image density non-uniformity occurs. Therefore, in order to suppress an image defect resulting from the foreign matter deposition, the grid is cleaned by the cleaning brush. Incidentally, the cleaning brush and a cleaning pad for cleaning the discharging wire are interrelated with each other, and by the following cleaning operation, cleaning of the grid electrode and cleaning of the discharging wire are carried out simultaneously.

In FIG. 4, (c) is the flowchart for illustrating a cleaning operation, carried out every predetermined sheet number as an image formation sheet number, for cleaning the discharging wire and the grid.

The control circuit C counts the image formation sheet number from the execution of the last cleaning, by a counter. That count is in a cleaning counter N, and a large/small relationship between the cleaning counter N and a cleaning threshold Z is compared and discriminated (S201). In this embodiment, Z was the image formation sheet number of 1000 sheets for A4 size. That is, the control circuit C starts a forward operation of the cleaning brush every time when the cleaning counter N exceeds 1000 sheet (S202). Incidentally, the counter N may only be required to be proportional to an operating time, and therefore also other than the image formation sheet number, an operating time of the charger is counted and may also be used as a discrimination criteria.

The control circuit C rotates the opening/closing motor 218 for a predetermined time (5 seconds in this embodiment) in a normal direction to move the cleaning brush (S202). Then, after a lapse of the predetermined time, a backward operation of the cleaning brush is executed (S203). In the backward operation, the control circuit C rotates the opening/closing motor 218 in a reverse direction to move the cleaning brush, and rotates the opening/closing motor 218 in the reverse direction until the cleaning brush moves to the home position (left end portion in FIG. 3). Further, when the position sensor 219 detects that the cleaning brush reached a stand-by place, the control circuit C stops the opening/closing motor 218 (S204).

Incidentally, as described above, in the constitution in this embodiment, the driving source is the same, and therefore the shutter opens and closes the opening with the cleaning operation. Similarly, with the opening/closing operation of the shutter, the grid is cleaned.

4. About Positional Relationship Between Cleaning Brush and Shutter

First, the grid shape and deformation of the fibers of the cleaning brush will be described, and thereafter behavior of a foreign matter dropping from the grid during the cleaning with the cleaning brush will be described.

(About Grid Shape and Deformation of Brush)

As described above, an etching pattern includes the base lines 206C substantially parallel to the rotational axis of the photosensitive drum 1 and the discharging wire and includes the thin lines (oblique lines) 206D having the angle θ with respect to the base lines (see (a) of FIG. 7). By the two base lines, the grid is partitioned into 3 sections, and the 3 sections divided by the base lines have a shape such that the 3 sections are partitioned in a fine mesh shape by the thin lines (oblique lines) 206D. In the case where the etching grid shown in (3) in Table 1 is employed, the angle θ formed between the generatrix of the photosensitive drum 1 and the thin line of the mesh is 45°. This thin line angle θ has the influence on the place on which the foreign matter drops.

In this embodiment, as described above, θ=45 was set. The angle (=angle formed between the base line 206C and the thin line (oblique line) 206D) θ formed with the photosensitive drum rotational axis is set at 45° which is not more than 80°. As a result, by a combination of an entering amount of the cleaning brush described later with the mesh shape having θ=45°, there is also an advantage that cleaning power at the grid surface is enhanced.

Subsequently, motion of tip of the fibers of the cleaning brush for cleaning the grid will be briefly described. In FIG. 7, (b) is a schematic view showing a state in which the fibers of the cleaning brush move in the mesh of the etching grid. Pile free ends of the cleaning brush enter the mesh finely divided by the base lines 206C and the thin lines (oblique lines) 206D. The plurality of cleaning brush piles continuously contact the foreign matter, deposited on the grid, plural times, so that foreign matter-removing power on the grid is enhanced. Further, a part of the piles enters the through holes of the mesh portion, whereby power for cleaning the foreign matter deposited on not only the flat surface portion opposing the discharging wire of the grid but also the cross-sectional edges of the through holes is also enhanced.

However, depending on the mesh shape and the entering amount of the brush, the part of the piles does not enter the mesh of the grid, so that the piles merely stroke the grid surface and thus high cleaning power cannot be expected. Therefore, the cleaning brush may preferably be set to have the entering amount such that the brush free ends enter the through holes of the mesh portion of the grid (i.e., the entering amount is 0 or more).

Figure 8:
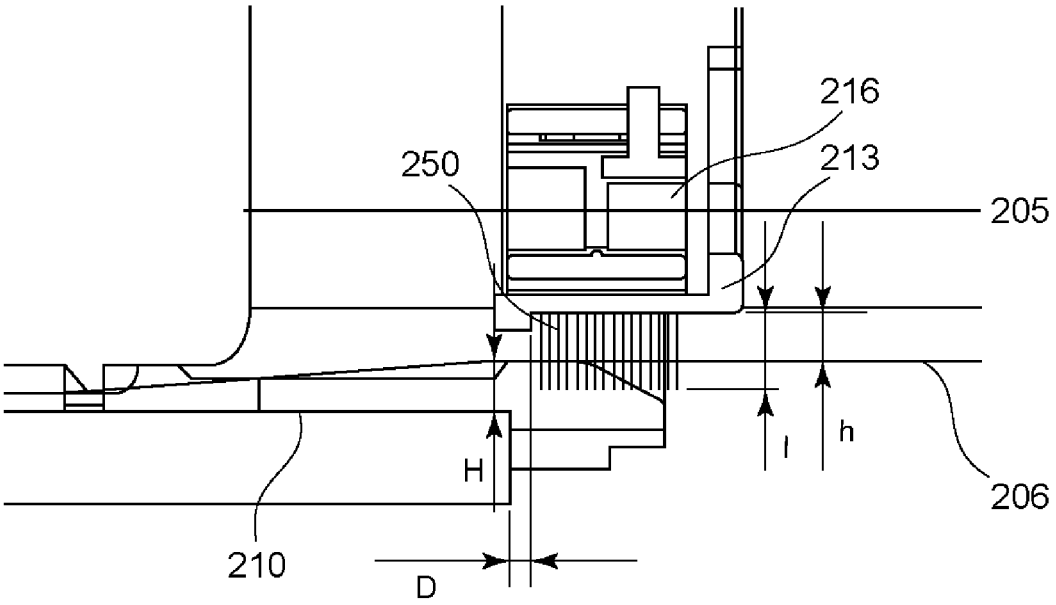
FIG. 8 is a schematic view for illustrating various dimensional relationships of the corona charger according to the embodiment.
Figure 9:
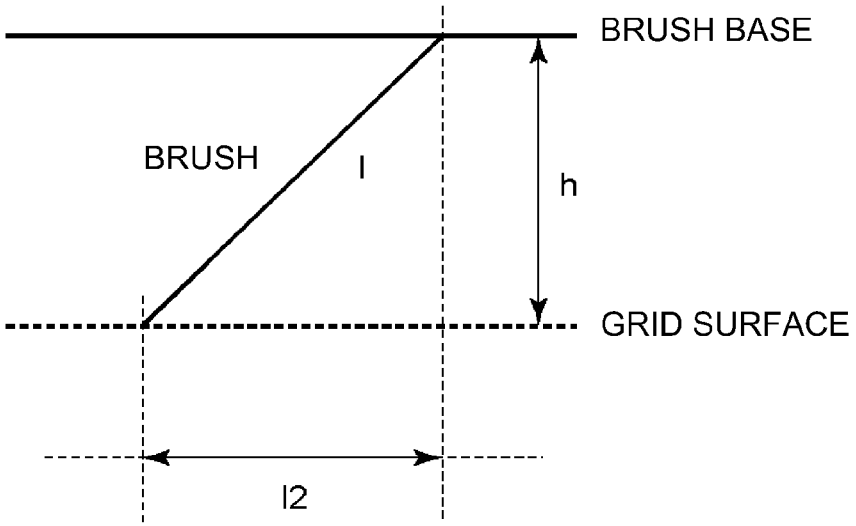
FIG. 9 includes schematic views for illustrating a delay amount of the cleaning brush free end.
Figure 9:
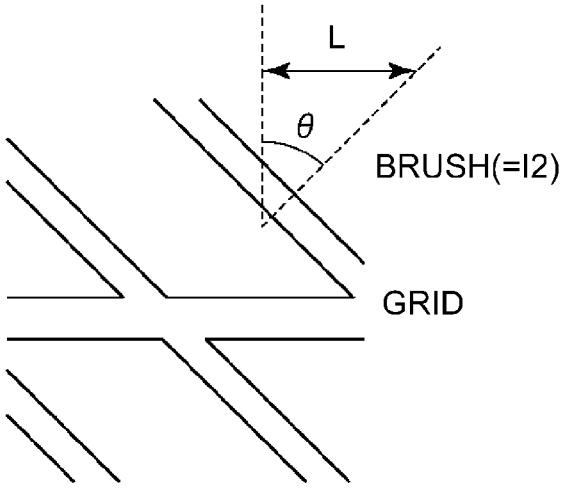

FIG. 8 is an enlarged view of a contact portion between the carriage and the grid in a state in which the above-described carriage retracts the grid toward the discharging wire side. As shown in FIG. 8, with respect to an advancing direction (shutter closing direction) when the shutter 210 is closed, the cleaning pad 216 and the cleaning brush 250 are disposed toward the closing direction than the leading end of the shutter 210. Further, the carriage 210 functions as a foundation as a base material for holding the cleaning brush 250. Here, the shortest distance from the carriage 213 constituting the foundation for the cleaning brush 250 to the grid 206 is h (mm), and a brush fiber length of the cleaning brush 250 is l (mm). Incidentally, the brush is formed with many fibers, and therefore as the brush fiber length l, an average length of the brush was used. Further, the shortest distance from the grid 206 to the shutter 210 with respect to a height direction during the shutter operation is H (mm), and a distance from a base of the fibers to the leading end of the shutter 210 at the rear end of the cleaning brush 250 with respect to a member direction is the closest state (mm). The brush entering the through holes of the mesh portion moves along the thin lines by the thin lines disposed obliquely to the carriage advancing direction. A movement amount of the brush at this time changes, as shown in (b) of FIG. 9, depending on the thin line angle θ (the angle formed between the longitudinal develop of the through holes and the longitudinal develop of the grid electrode. When only a result will be briefly described, a delay amount L of the brush free end by the grid is $\sqrt{(l^2-h^2)}\times\sin\theta$. In the following, the drop of the foreign matter when both the cleaning brush for cleaning the grid and the shutter are moved at the same speed V will be described.

(About Motion of Brush Free End and Drop of Foreign Matter)

Motion of the cleaning brush free ends will be described using FIG. 10. The foreign matter deposits on the grid with continuous image formation. For that reason, when the cleaning brush is moved in the direction of closing the shutter after the end of the image formation, most of the foreign matter on the grid drops toward the photosensitive member. In other words, also when the shutter is moved in the opening direction, the cleaning brush cleans the grid, but a deposition amount of the foreign matter is small compared with the case where the cleaning brush cleans the brush by moving the shutter in the closing direction. For that reason, the foreign matter dropping from the grid by the brush moving in the shutter closing direction will be described.

The brush free ends of the grid cleaning brush 250 contacting the grid deform so as to follow the grid depending on elasticity of the brush. As shown in (a) of FIG. 10, the cleaning of the grid is performed while the brush free ends in a state in which the brush free ends penetrate through the through holes of the mesh portion of the grid 206 to protrude from the mesh portion and in a state in which the brush free ends follow the grid surface without penetrate through the through holes of the mesh portion coexist.

Figure 10:
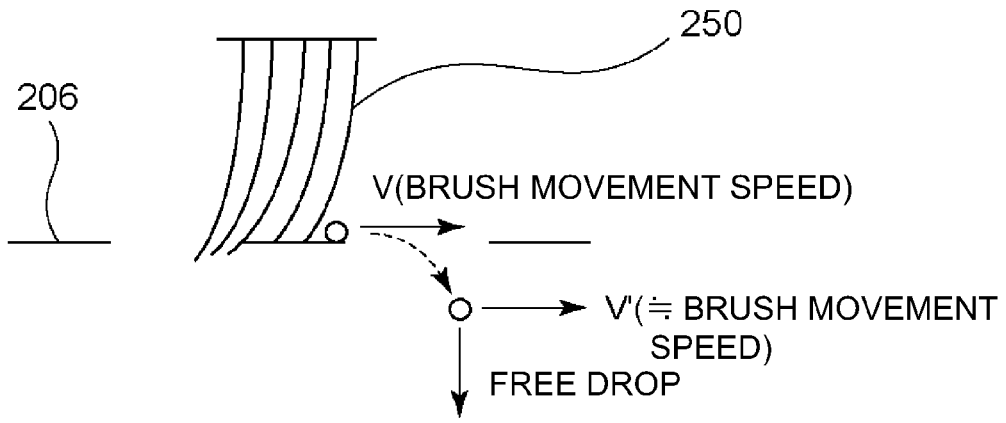
FIG. 10 includes a schematic view and a graph showing behavior of a foreign matter during grid cleaning according to the embodiment.
Figure 10:
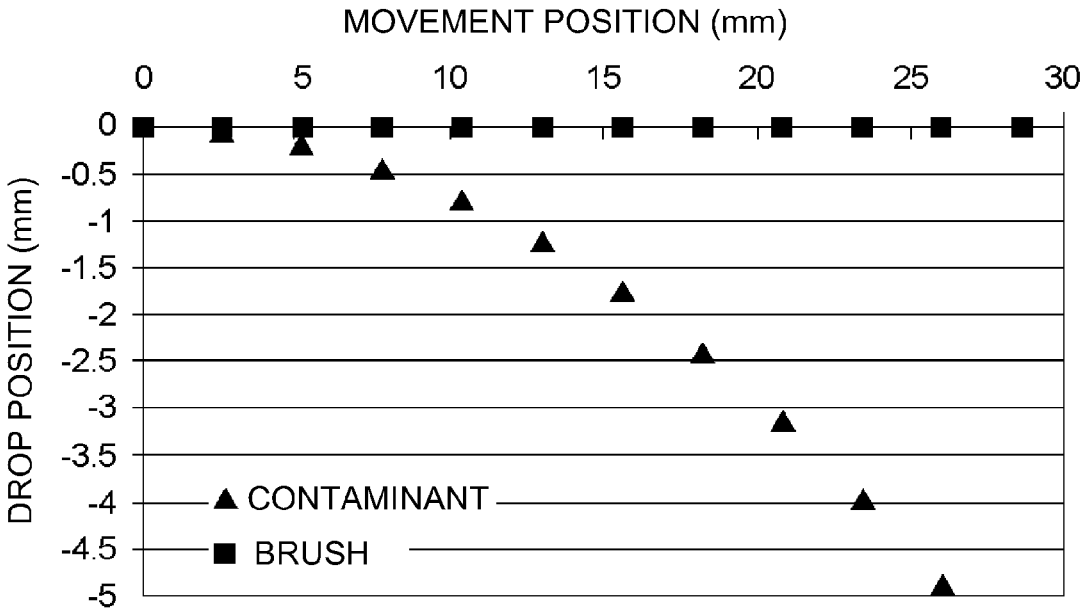

As shown in (a) of FIG. 10, the grid cleaning brush 250 moves on the grid 206 at the moving speed V. The carriage 213 moves at the moving speed V by the drive from the screw. However, in accordance with the mesh shape of the grid as shown in (b) of FIG. 7, the cleaning brush 250 receives a component of force along the base lines 206C and the thin lines (oblique lines) 206D of the grid. For that reason, as shown in (a) of FIG. 9, the brush free ends delay compared with the carriage (the base of the brush) with respect to the advancing direction. Further, the brush is caught by the mesh shape of the grid, so that the brush moves along the mesh shape of the grid. That is, as shown in (b) of FIG. 7, the brush cleans the grid while producing zigzag motion. The zigzag motion is constituted by an operation for cleaning the flat surface portion of the grid so as to ride on and sweep the flat surface portion and an operation in which the brush slides sideway on the cross-sectional edges of the grid along the mesh shape of the grid. As described above, the grid shape in this embodiment constitutes a pattern of the thin lines (oblique lines) 206D deviated from a line perpendicular to the rotational axis, of the photosensitive drum, which is the advancing and movement direction of the cleaning brush. In other words, the through holes provided in the grid at the mesh portion have an angle other than 90° with respect to the advancing and movement direction of the cleaning brush. As a result, the motion such that the grid cleaning brush free ends slide sideway on the cross-sectional edge portions of the grid is produced. By this side-sliding operation, it is possible to remove also a slight foreign matter at the cross-sectional edge with reliability. Further, the cleaning brush reliably cleans not only the cross-sectional edge portions but also the grid surface opposing the discharging wire by moving while contacting the grid surface in the zigzag motion of the plurality of brushes.

The above-described zigzag motion move decreases with the grid shape angle, (the angle formed between the longitudinal direction of the through holes and the longitudinal direction of the grid electrode) of the thin lines (oblique lines) 206D with respect to the photosensitive drum rotational axis which is the advancing and movement direction of the cleaning brush, closer to 90°. That is, the free ends of the cleaning brush 250 linearly move on the grid with respect to the advancing direction. Incidentally, when a relationship between a cleaning performance by the cleaning brush and the grid pattern angle (the angle formed between the through hole longitudinal direction and the grid electrode longitudinal direction) is studied, it was found that the cleaning performance for (cleaning) the foreign matter deposited on the grid surface is high when the grid pattern angle may preferably 80° or less, more preferably be in a range of 45°±25°.

As described above, compared with the base of the cleaning brush in which the thin lines are obliquely provided, the brush free ends cause the delay. As shown in (a) of FIG. 9, the grid cleaning brush 250 delays at the free ends relative to the base of the brush by a distance l2 (mm) (delay distance). The delay distance is the distance l2=*√(l^2−h^2) seen from a side surface at this time. Incidentally, the brush has elasticity, and therefore has a curve, not a rectilinear line as shown in (a) of FIG. 9.

In the following, description will be made on the assumption that in the grid cleaning brush 250, the delay distance l2 of the free ends relative to the base of the brush becomes maximum. The brush free ends seen from the lower surface in the photosensitive member side when the brush free ends delay are shown. The brush free ends are l2 in length, and the brush moves along the grid mesh angle θ. A delay amount of the brush free ends of an advancing direction component of the brush at that time is L=l2×sin θ(=√(l^2−h^2)×sin θ).

From the above, there is a need that the distance (D) from the cleaning brush 250 to the leading end of the shutter 210 satisfies: (D−L)≥0 mm. In this embodiment, a distance from the carriage 213 constituting the foundation of the cleaning brush 250 to the grid 206 is h=2.0 mm, the brush fiber length of the cleaning brush 250 is l=3.0 mm, and the grid shape pattern (the angle formed between the through hole longitudinal direction and the grid electrode longitudinal direction) is θ=45°.

From the above numerical values, l2=√(3^2−2^2)=√5 mm, so that the brush free end delay amount L=√5×sin 45°≈1.58 mm. Further, as described above, the distance from the cleaning brush 250 to the leading end of the shutter 210 is D=2.5 mm, and therefore a relationship in which D−L=2.5−1.58≥0 holds is established. Incidentally, when the grid shape pattern angle θ is 90°, the brush free end delay amount L of the brush advancing direction component is L≈2.24 mm from the above-described formula. When compared with L≈1.58 mm at the time of the grid shape pattern angle θ of 45°, L≈2.24 mm at the time of 90° is large. For that reason, when the grid shape pattern angle θ is 90°, in order to satisfy: (D−L)≥0 mm, necessity for upsizing the charging device becomes high although the necessity is slight. Also from that, it can be said that the grid shape pattern provides the angle other than 90° and may more preferably provide the angle in the range of 45±25°.

In this embodiment, in the case where the brush is moved at the speed V in the longitudinal direction, the dimensions were set in the following manner on the assumption that the foreign matter on the grid freely drops by the speed component in the brush movement direction at a speed (V'≈1.2 to 0.8 V) substantially equal to the brush movement speed.

A distance from the carriage 213 constituting the foundation for the cleaning brush 250 to the grid 206 was h=2.0 mm. Further, the brush fiber length of the cleaning brush 250 was l=3.0 mm, the shortest distance from the grid 206 to the shutter 210 during the shutter operation was H=2.0 mm, and the distance from the cleaning brush 250 to the leading end of the shutter 210 was D=2.5 mm.

When the foreign matter deposits on the shutter during removal, by the cleaning brush of the foreign matter (toner and external additive, electric discharge product, dust) deposited on the grid, the deposited foreign matter causes an image defect and a deterioration of the shutter. Therefore, in this embodiment, the shutter is operated in a state in which a space of the distance D=2.5 (mm) is created between the shutter 210 and the cleaning brush 250. By creating the space of the distance D=2.5 (mm) between the shutter and the cleaning brush with respect to the photosensitive drum axial direction, the foreign matter, on the grid, removed by the cleaning brush 250 can be removed without being dropped onto the shutter.

(Result of Observation Using High-Speed Camera)

As described above, with respect to the behavior of the cleaning brush free ends and the drop of the foreign matter, verification was made using a high-speed camera. Observation was performed by taking photographs at a rate of 2,000 frames/sec using a high-speed camera ("Phantom V12.1", manufactured by Vision Research Inc.).

From the image forming apparatus in which the charging device including the cleaning brush is mounted, 100,000 sheets of an A4-sized image of 50% in image ratio were continuously outputted in an environment of a temperature of 32° C. and a humidity of 85%. Thereafter, the drop of the foreign matter when the grid is cleaned by the cleaning brush was checked using the above-described high-speed camera.

In the case where the brush is moved at the speed V in the longitudinal direction, the foreign matter on the grid has the speed component in the brush movement direction at the speed (V'≈1.2 to 0.8) substantially equal to the brush movement speed, and has dropped freely. This was the substantially same as the result obtained from the above-described model.

In FIG. 10, (b) is a graph for illustrating the behavior during the drop of the foreign matter from the grid when the grid is cleaned. As described above, the distance from the carriage 213 constituting the foundation for the cleaning brush 250 to the grid 206 is h=2.0 mm, and the brush fiber length of the cleaning brush 250 is l=3.0 mm, so that a relationship of h>l holds. In other words, the cleaning brush is disposed so as to enter the grid by 1.0 mm.

For that reason, as shown in (a) of FIG. 10, the cleaning brush moves on the grid at the speed V. During the movement, the cleaning brush 250 contacting the grid 206 cleans the grid while deforming depending on the elasticity of the brush. The foreign matter on the grid is removed from the grid by the cleaning brush at the speed V'. From the observation result of the high-speed camera, the speed V' given to the foreign matter on the grid was the substantially same speed as the moving speed V of the cleaning brush for cleaning the grid.

Therefore, to the foreign matter on the grid, the speed V (≈V') is given, so that the foreign matter drops freely from the grid. In (b) of FIG. 10, a movement position is the abscissa, and a drop position is the ordinate, movement of the removed foreign matter and movement of the cleaning brush were shown in a graph. As is apparent from the graph, with respect to the movement direction, the foreign matter and the cleaning brush show the substantially same movement. That is, if the cleaning brush and the shutter do not overlap with each other with respect to the movement direction, the foreign matter removed by the cleaning brush does not drop onto the shutter. In order to prevent the foreign matter from dropping onto the shutter, when described using the sectional view of FIG. 8, there is a need that the distance from the cleaning brush 250 to the leading end of the shutter 210 is D≥0 mm.

However, in the case where the cleaning brush is a brush having elasticity, the brush free ends contacting the grid move with some delay. For that reason, when the distance is simply D≥0 mm, the foreign matter drop onto the shutter cannot be suppressed. This is a need that the distance from the cleaning brush 250 to the leading end of the shutter 210 during the operation is D≥0 mm. That is, by satisfying (D−L)≥0 mm, the drop of the foreign matter, removed by the cleaning brush 250, onto the shutter 210 positioned at a lower portion of the cleaning brush 250 with respect to a direction of gravitation can be suppressed. As a result, the grid can be cleaned without contaminating the shutter, and therefore it is possible to suppress charging non-uniformity over a long term while suppressing an occurrence of a defective image generated by the contamination of the shutter.

Incidentally, in the above-described embodiment, an example in which the cleaning brush and the shutter are driven by the same screw and are moved in an interrelation manner was described, but a constitution in which the cleaning brush and the shutter are moved independently of each other so that when the shutter is moved in the closing direction, the cleaning brush moves in advance of the leading end portion of the shutter with respect to the closing direction by a predetermined interval or more.

[Industrial Applicability]

According to the present invention, in the charging device including the shutter for shielding the opening provided in the casing surrounding the discharge electrode and including the cleaning member for cleaning the grid electrode, it is possible to suppress the deposition of the foreign matter on the shutter.

The invention claimed is:

1. A charging device comprising:

a discharging electrode;

a casing surrounding said discharging electrode and being provided with an opening in a member-to-be-charged side;

a grid electrode provided in the opening and provided with a mesh portion having a plurality of through holes;

a cleaning brush, including a base material and a plurality of fibers held on the base material, for cleaning said grid electrode by entrance of a part of the fibers into the through holes while contacting a surface of said grid electrode in a discharging electrode side;

a shutter capable of shielding between a member-to-be-charged and said grid electrode; and a moving mechanism for moving said cleaning brush and said shutter along a longitudinal direction of said grid electrode, wherein when said shutter is moved in a closing direction, said cleaning brush moves in advance of a leading end portion of said shutter with respect to the closing direction by a predetermined interval or more.

2. A charging device according to claim 1, wherein when an average length of the fibers is l, a distance from the base material to the surface of said grid electrode is h, and an angle formed between a longitudinal direction of the through holes in said grid electrode and the longitudinal direction of said grid electrode is θ, a distance D along the longitudinal direction of said grid electrode from a base portion of the fibers at a movement direction rear end of said cleaning brush, moving in advance of the leading end portion of said shutter when said shutter is moved in the closing direction, to the leading end portion of said shutter with respect to the closing direction has the following relationship:

$$D > \sqrt{(l^2 - h^2)} \times \sin\theta.$$

3. A charging device according to claim 2, wherein the angle θ formed between the longitudinal develop of the through holes in said grid electrode and the longitudinal develop of said grid electrode is 80° or less.

4. A charging device according to claim 2, wherein the angle θ formed between the longitudinal develop of the through holes in said grid electrode and the longitudinal develop of said grid electrode is within a range from 20° to 70°.

5. A charging device according to claim 2, wherein the distance D has the following relationship:

$$1.2.\times\sqrt{(l^2-h^2)}\times\sin\theta \geq D > \sqrt{(l^2-h^2)}\times\sin\theta.$$

* * * * *